United States Patent [19]

Lipp

[11] Patent Number: 4,857,075

[45] Date of Patent: Aug. 15, 1989

[54] APPARATUS FOR USE WITH PRESSURIZED REACTORS

[75] Inventor: Charles W. Lipp, Baton Rouge, La.

[73] Assignee: The Dow Chemical Company, Midland, Mich.

[21] Appl. No.: 196,155

[22] Filed: May 19, 1988

[51] Int. Cl.[4] ..... C10V 3/48

[52] U.S. Cl. ..... 48/86 R; 48/DIG. 7; 239/132.3; 239/400; 239/403; 239/424.5

[58] Field of Search ..... 48/86 R, 77, 73, DIG. 7; 239/132.3, 419.3, 422, 424.5, 427.5, 400, 403, 405, 406, 428

[56] References Cited

U.S. PATENT DOCUMENTS

| | | | |
|---|---|---|---|
| 1,510,039 | 9/1924 | Canfield | 239/403 |
| 3,980,233 | 9/1976 | Simmons et al. | 239/400 |
| 4,371,378 | 2/1983 | Brent et al. | 239/405 |
| 4,386,941 | 6/1983 | Crouch et al. | 48/206 |
| 4,443,228 | 4/1984 | Schlinger | 48/DIG. 7 |
| 4,443,230 | 4/1984 | Stellaccio | 48/DIG. 7 |
| 4,566,880 | 1/1986 | Seipenbusch et al. | 48/86 R |
| 4,705,535 | 11/1987 | Lipp | 48/DIG. 7 |

*Primary Examiner*—Peter Kratz

[57] ABSTRACT

A process burner for combusting a fluid feed material which has central, middle and frusto-conical conduits in which the central and middle conduits form an annular passageway having an enlarged upstream end forming a distribution chamber to prevent high fluid flow regions which would erode an acceleration conduit at the discharge ends of the central, middle and frusto-conical conduits, the acceleration conduit forming a smooth curving surface without sharp angles from the frusto-conical conduit apex to the cylindrical discharge portion of the acceleration conduit. The distribution chamber preferably has a baffle or mixing plate angularly disposed under the fluid feed inlet to the annular passageway so that the fluid feed changes from axial to downwardly spiralling radial flow.

8 Claims, 2 Drawing Sheets

APPARATUS FOR USE WITH PRESSURIZED REACTORS

BACKGROUND OF THE INVENTION

This invention relates to an apparatus capable of effecting the introduction of fluid feeds to a pressurized reactor. In one of the more specific aspects of this invention, the method and apparatus relate to the manufacture of $H_2$ and CO containing gaseous products, e.g., synthesis gas, reducing gas and fuel gas, by the high pressure partial oxidation of carbonaceous slurries.

Processes for and apparatuses used in the pressurized partial oxidation of carbonaceous slurries are both well known in the art. See, for example, U.S. Pat. Nos. 4,113,445; 4,353,712; and U.S. 4,443,230. In most instances, the carbonaceous slurry and an oxygen containing gas are fed to a reaction zone which is at the temperature, generally about 2500° F. (1370° C.). Bringing the reactor up to such temperature can be achieved by at least two methods. In one of the methods, a simple preheat burner is affixed, in a nonairtight manner, to the reactor's burner port. This preheat burner introduces a fuel gas, e.g., methane, into the reaction zone to produce a flame sufficient to warm the reactor to a temperature of about 2000°–2500° F. (about 1090°–1370° C.) at a rate which does not do harm to the reactor refractory material. Generally, this rate is from about 40° F./hr to about 80° F./hr (about 22°–44° C./hr.). During this preheat stage, the reaction zone is kept at ambient pressure or slightly below. The less than ambient pressure is desirable as it causes air to enter the reactor through the nonairtight connection between the preheater and the reactor, which air is then available for use in combusting the fuel gas. After the desired preheat temperature is achieved, the preheat burner is removed from the reactor and is replaced by the process burner. This replacement should occur as quickly as possible as the reaction zone will be cooling down during the replacement time. Cool downs to a temperature as low as 1800° F. (982° C.) are not uncommon. If the reaction zone temperature is still within the acceptable temperature range, the carbonaceous slurry and the oxygen containing gas, with or without a temperature moderator, are fed through the process burner to achieve partial oxidation of the slurry. Care must be taken to prevent raising the reaction zone temperature too quickly with the process burner as thermal shock can damage the reactor's refractory material.

If the reaction zone temperature is below the acceptable temperature range, the preheater must then be placed back into service. In these instances, time is lost and additional labor expense is realized with the replacement duplication.

The other of the two methods for bringing up the reaction zone temperature to within a desirable range entails the use of a dual-purpose burner which is capable of acting as a preheat and as a process burner; see, for example, the burner disclosed in U.S. Pat. No. 4,353,712. This type of burner provides conduits for selective and contemporaneous feeding of carbonaceous slurry, oxygen-containing gas, fuel gas and/or temperature moderators. When the burner is used for preheating the reactor, the burner feeds the oxygen-containing gas and the fuel gas in the proper proportions to achieve complete combustion. After the reaction zone temperature is within the desired range, the fuel gas can either be replaced completely by the carbonaceous slurry or co-fed with the slurry. When the co-feeding mode is used, generally the fuel gas feed is reduced so that there will only be partial oxidation occurring. Co-feeding is usually used when initially introducing the carbonaceous slurry to the reactor and when maintaining reaction zone temperature until process conditions can be equilibrated for the carbonaceous slurry/oxygen-containing gas feed mode of operation. While the use of a dual-purpose process burner does not suffer from the loss in process time and the additional labor expenses of the preheat burner/process burner method, it is not without its own drawbacks. When using the dual-purpose burner, the maintenance of flame stability under both preheat conditions, i.e., ambient pressure-complete oxidation and high-pressure, partial-oxidation conditions, is difficult and can result in lowering of process reliability.

Some in the synthesis gas industry have proposed using the combination of a preheat burner and a process burner in which the latter is capable of providing a selective contemporaneous feed of carbonaceous slurry, oxygen-containing gas, fuel gas and/or temperature moderators. While this combination may still entail the loss of process time and the realization of labor costs associated with the preheat burner replacement by the process burner, the selective contemporaneous feed feature of the process burner is used to reduce the before-discussed thermal shock to the reactor refractory material. The reduction in thermal shock is achieved by bringing the reaction zone temperature from its cooled-down temperature, after preheat burner removal, back up to the desired temperature by initially using a feed of oxygen and fuel gas and gradually replacing the fuel gas with carbonaceous slurry. By gradually increasing the carbonaceous slurry feed at a low rate, there is less of the slurry liquid to heat and vaporize and thus a minimization of reactor temperature dip. Further, during the initial period of carbonaceous slurry feed, the continued feeding of the fuel gas results in the addition of heat to the reactor. The fuel gas is combusted under partial oxidation conditions so that there is little contamination by $O_2$, etc., of the gas product.

For a process burner to be useful in the just-described procedure, it must be capable of providing to the reactor, in an efficient manner, the oxygen-containing gas and both the carbonaceous slurry and the fuel gas feeds. Efficiency demands that the carbonaceous slurry be evenly dispersed in the oxygen-containing gas and be in a highly atomized state, e.g., having a maximum droplet size less than about 1000 microns. Both uniform dispersion and atomization help insure proper burn and the avoidance of hot spots in the reaction zone.

It is therefore an object of this invention to provide a process burner which is capable of providing selective and contemporaneous feed of three or more fluid feed streams to a reaction zone while at the same time providing atomization of and uniform dispersion of the carbonaceous slurry in the oxygen-containing gas.

THE INVENTION

This invention relates to a novel and improved process burner for use in the manufacture of synthesis gas, fuel gas, or reducing gas by the partial oxidation of a carbonaceous slurry in a vessel which provides a reaction zone normally maintained at a pressure in the range of from about 15 to about 3500 psig (about 103.4 to about 24,131.7 kilopascals) and at a temperature within the range of from about 1700° to about 3500° F. (about 925° to about 1925° C.). The improvement in the burner structure provides an improved combustion process which includes introducing a carbonaceous slurry and an oxygen-containing gas to the improved process burner, which discharges into the reaction zone.

Within the process burner, there is formed concentric and radially spaced streams. The formed streams comprise a central cylindrical oxygen-containing gas stream having a first velocity, an annular carbonaceous slurry stream having a second velocity, and a frusto-conical oxygen-containing gas stream having a third velocity. The central cylindrical oxygen-containing gas stream and the annular carbonaceous slurry stream have substantially coplanar discharge ends while the frusto-conical oxygen-containing gas stream, at its discharge end, converges into the central cylindrical oxygen-containing gas stream and the annular carbonaceous slurry stream. The velocities of the central cylindrical oxygen-containing gas stream and the annular carbonaceous slurry stream are greater than the velocity of the annular carbonaceous slurry stream. It is preferred that the two oxygen-containing gas streams have a velocity of from about 75 ft/sec (about 23 m/sec) to about sonic velocity and that the carbonaceous slurry stream has a velocity within the range of from about 1 ft/sec (about 0.365 m/sec) to about 50 ft/sec (about 15 m/sec). The disparity between the stream velocities and the convergence of the frusto-conical oxygen-containing gas stream into the other two streams causes the carbonaceous slurry stream to disintegrate. This disintegration has two effects, i.e., the carbonaceous slurry is initially atomized and a uniform first dispersion of the initially atomized carbonaceous slurry and the oxygen-containing gas is formed. A second dispersion is formed by accelerating the first dispersion through an acceleration zone to further atomize the initially atomized carbonaceous slurry. The acceleration zone extends from a point downstream of the before mentioned streams to a point of discharge from the process burner. The acceleration zone has a cross-sectional area for flow less than the cross-sectional area for flow of the streams at their discharge ends. The second dispersion, which contains the highly atomized carbonaceous slurry, is then discharged from the acceleration zone into the reaction zone.

Accelerating the first dispersion through the acceleration zone is effected by providing a pressure, $P_1$, at a point adjacent the upstream end of the acceleration zone which is greater than a pressure, $P_2$, measured at a point exterior of the process burner which is adjacent the discharge end of the acceleration zone. The difference between $P_1$ and $P_2$ is preferably maintained between about 10 to about 1500 psi (about 4.48 to about 703.3 kilopascals). In accordance with the laws of fluid dynamics and with the assumption of a constant stream throughput, the first dispersion will thus be accelerated as it passes through the acceleration zone. Also, the oxygen-containing gas portion of the first dispersion will accelerate quicker than the carbonaceous slurry particles formed by the initial atomization. This difference in velocity causes further shearing of the carbonaceous slurry particles to yield further atomization of these particles. The acceleration zone is preferably cylindrical in shape, however, other configurations may be utilized. The dimensions of the acceleration zone are determinative of the residence time within the acceleration zone of the first dispersion and therefore are, at least in part, determinative of the degree of further atomization which occurs. The configuration and dimensions of the acceleration zone which will give the desired atomization are in turn dependent upon the $P_1$ and $P_2$ difference, the carbonaceous slurry viscosity, the temperature of the carbonaceous slurry, and the oxygen-containing gas, the presence of a temperature moderator, the relative amounts of the carbonaceous slurry and the oxygen-containing gas, and the like. With this number of variables, empirical determination of the acceleration zone configuration and dimensions is required. The improved process burner of this invention is affixed to the vessel whereby the carbonaceous slurry, and oxygen-containing gas and, optionally, a temperature moderator are fed through the burner into the reaction zone. The burner additionally provides for feeding, into the reaction zone, a fuel gas such as methane. The burner is capable of selectively and contemporaneously handling all of these streams.

Due to its unique configuration, the process burner of this invention is capable of providing to the reaction zone the carbonaceous slurry in a highly atomized form, i.e., the carbonaceous slurry has a volume median droplet size in the range of from about 100 to about 600 microns. Not only is the carbonaceous slurry highly atomized, it is also substantially uniformly dispersed in the oxygen-containing gas at the time that the slurry and gas are introduced into the reaction zone. By being able to provide such atomization and uniformity of dispersion, improved and highly uniform combustion is achieved in the reaction zone. Prior art process burners which do not provide the degree of atomization or dispersion of the carbonaceous slurry and the oxygen-containing gas can experience uneven burning, hot spots, and the production of unwanted by-products such as carbon, $CO_2$, etc. It is also an important feature of this invention that the uniform dispersion and atomization occur interiorly of the nozzle. Having the dispersion and atomization substantially completed within the nozzle, allows for more exact control of the degree of atomization of the carbonaceous slurry before it is combusted in the reaction zone. The prior art nozzles which attempt to effect most, if not all, of the atomization within the reaction zone have less control over particle size as further atomization is forced to occur in an area, i.e., the reaction zone, which is by atomization standards unconfined. Also, the atomization process in the reaction zone has to compete time-wise with the combustion of the carbonaceous slurry and the oxygen-containing gas.

A preferred feature of the process burner of this invention is that it provides for the introduction of fuel gas to the reaction zone, which introduction is exterior of the process burner. This fuel gas stream is discharged from the process burner into the reaction zone along a line which intersects the downstream extended longitudinal axis of the acceleration zone. One of the benefits realized by this line of discharge is that the fuel gas flame is maintained at a distance from the burner face. If the fuel gas flame is adjacent the burner face then burner damage can occur. When the oxygen-containing gas is high in $O_2$ content, say 50%, then the introduction of fuel gas from the interior of a process burner is most undesirable as the flame propagation of most fuel gases in a high $O_2$ atmosphere is very rapid. Thus, there is always the danger that the flame could propagate up into the burner causing severe damage to the burner.

To achieve the uniform dispersion of the carbonaceous slurry within the oxygen-containing gas, one embodiment of this invention features a process burner which provides structure to yield a frusto-conical stream of the oxygen-containing gas which is at a first velocity. Other burner structure provides a carbonaceous slurry stream which is cylindrical in shape and which is at a second velocity. The cylindrical stream is located so that it intersects the inside surface of the frusto-conical stream of the oxygen-containing gas. The angle of intersection is preferably within the range of from about 15° to about 75°. The frusto-conical stream preferably has a velocity of from about 75 ft/sec to sonic velocity and should be greater than the preferred velocity of the carbonaceous slurry stream which is within the range of from about 1 to about 50 ft/sec.

By providing the intersection of the cylindrical carbonaceous slurry stream with the frusto-conical oxygen-containing gas stream and by having the disparity between the two stream's velocities, the substantially uniform dispersion provided by the process nozzle of this invention is achieved. It is believed, but the process burner of this invention is not limited to this theory, that the frusto-conical stream shears and at least atomizes a portion the cylindrical slurry stream.

In another embodiment of this invention, the process burner has structure to provide a center cylindrical oxygen-containing gas stream, an annular carbonaceous slurry stream and a frusto-conical oxygen-containing gas stream. These streams are concentric with and radially displaced from another so that the center gas stream is within the annular carbonaceous slurry stream and so that the annular carbonaceous slurry stream will intersect the frusto-conical oxygen-containing gas stream at an angle within the range of from about 15° to about 75°. The velocities of the oxygen-containing gas streams are within the range of from about 75 ft/sec to about sonic velocity and are greater than the slurry stream which has a minimum velocity of about 1 ft/sec. Substantially uniform dispersion of the carbonaceous slurry in the oxygen-containing gas is achieved by the arrangement of streams and their velocity disparity. The frusto-conical and the center cylindrical oxygen-containing gas streams both provide shearing of the annular slurry stream to effect the dispersion and initial atomization of the slurry stream. Subsequent to the dispersion and initial atomization, the dispersion of slurry and gas is passed through an acceleration zone. As is the case for the before-described first embodiment, the acceleration zone can be provided by a downstream hollow cylindrical conduit having a longitudinal cross-section in which the sides of the interior bore converge in a smooth curve to the apex of the frusto-conical conduit. For the present embodiment, the hollow cylindrical conduit has a cross-sectional area which is less than the combined cross-sectional areas of the annular carbonaceous slurry stream and the central cylindrical and frusto-conical oxygen-containing streams. The operation and dimensioning criteria of this hollow cylindrical conduit is the same as that for the hollow cylindrical conduit of the previously described first process burner embodiment.

Another preferred embodiment of the process burner of this invention provides an annular passageway which has an enlarged upper section to allow equalization of fluid flow, particularly carbonaceous slurry, and thus prevent excessive wear caused by high fluid flow regions. In this invention there is provided an annular passageway formed by the annulus between the central and middle conduits which has an elongated upper and lower section and in which the upper section has a larger annular cross-sectional area than the lower section. The upper end of the annular passageway is closed, except for a fluid feed inlet, which because of the central conduit passing through the middle conduit is offset from the longitudinal axis. Because of this offset there is possible regions of the annular passageway or frusto-conical passageway or acceleration conduit which may experience high fluid flow regions and wear excessively to prevent this excessive wear, a distribution chamber is formed in the enlarged upper section of the annular passageway. The distribution chamber contains a baffle or mixing plate disposed adjacent to the fluid feed inlet and thereunderneath to divert substantially all of the inlet fluid feed from axial flow to substantially radial flow around the annulus. This radial flow allows time for the equalization of flow and reduction of wear through the lower section of the annular passageway and other downstream parts of the process burner of this invention.

A most preferred process burner of this invention has both features of the smoothly converging acceleration conduit walls and the distribution chamber containing the mixing plate or baffle. This process burner, like the first process burner embodiment, provides for feed of a fuel gas to the reaction zone for dispersion within the carbonaceous slurry/oxygen-containing gas dispersion in the reaction zone. This fuel gas dispersion occurs exteriorly of the process burner.

The non-catalytic partial oxidation process for which the process burners of this invention are especially useful produces a raw gas stream in a reaction zone which is provided by a refractory-lined vessel. The process burner can be either temporarily or permanently mounted to the vessel's burner port. Permanent mounting can be used when there is additionally permanently mounted to the vessel a preheat burner. In this case, the preheat burner is turned on to achieve the initial reaction zone temperature and then turned off. After the preheat burner is turned off, the process burner of this invention is then operated. Temporary mounting of the process burner is used in those cases where the preheat burner is removed after the initial heating and replaced by the process burner.

As mentioned previously, for the manufacture of synthesis gas, fuel gas or reducing gas, by the partial oxidation of a carbonaceous slurry, generally takes place in a reaction zone having a temperature within the range of from about 1700° to about 3500° F. (about 925° to about 1925° C.) and a pressure within the range of from about 15 to about 3500 psig (about 103.4 to about 24,131.7 kilopascals). A typical partial oxidation gas generating vessel is described in U.S. Pat. No. 2,809,104. The produced gas stream contains, for the most part, hydrogen and carbon monoxide and may contain one or more of the following: $CO_2$, $H_2O$, $N_2$, Ar, $CH_4$, $H_2S$ and COS. The raw gas stream may also contain, depending upon the fuel available and the operating conditions used, entrained matter such as particulate carbon soot, flash or slag. Slag which is produced by the partial oxidation process and which is not entrained in the raw gas stream will be directed to the bottom of the vessel and continuously removed therefrom.

The term "carbonaceous slurries" as used herein refers to slurries of solid carbonaceous fuels which are pumpable and which generally have a solids content within the range of from about 40 to about 80% and which are passable through the hereinafter described conduits of the process nozzles of this invention. These slurries are generally comprised of a liquid carrier and the solid carbonaceous fuel. The liquid carrier may be either water, liquid hydrocarbonaceous materials, or mixtures thereof. Water is the preferred carrier. Liquid hydrocarbonaceous materials which are useful as carriers are exemplified by the following materials: liquefied petroleum gas, petroleum distillates and residues, gasoline, naphtha, kerosene, crude petroleum, asphalt, gas oil, residual oil, tar, sand oil, shale oil, coal-derived oil, coal tar, cycle gas oil from fluid catalytic cracking operations, furfural extract of coke or gas oil, methanol, ethanol, other alcohols, by-product oxygen-containing liquid hydrocarbons from oxo and oxyl synthesis and mixtures thereof, and aromatic hydrocarbons such as benzene, toluene, xylene, etc. Another liquid carrier is liquid carbon dioxide. To ensure that the carbon dioxide is in liquid form, it should be introduced into the process burner at a temperature within the range of from about −67° F. to about 100° F. (−54.9 to 37.8° C.) depending upon the pressure. It is reported to be most advantageous to have the liquid slurry comprise from about 40 to about 70 weight percent solid carbonaceous fuel when liquid $CO_2$ is utilized.

The solid carbonaceous fuels are generally those which are selected from the group consisting of coal, coke from coal, char from coal, coal liquefication residues, petroleum coke, particulate carbon soot in solids derived from oil shale, tar sands and pitch. The type of coal utilized is not generally critical as anthracite, bituminous, subbituminous and lignite coals are useful. Other solid carbonaceous fuels are for example: bits of garbage, dewatered sanitary sewage, and semi-solid organic materials such as asphalt, rubber and rubber-like materials including rubber automobile tires. As mentioned previously, the carbonaceous slurry used in the process burner of this invention is pumpable and is passable through the process burner conduits designated. To this end, the solid carbonaceous fuel component of the slurry should be finely ground so that substantially all of the material passes through and ASTM E 11-70C Sieve Designation Standard 140 mm (Alternative Number 14) and at least 80% passes through an ASTM E 11-70C Sieve Designation Standard 425 mm (Alternative Number 40). The sieve passage being measured with the solid carbonaceous fuel having a moisture content in the range of from about 0 to about 40 weight percent.

The oxygen-containing gas utilized in the process burner of this invention can be either air, oxygen-enriched air, i.e., air that contains greater than 20 mole percent oxygen, and substantially pure oxygen.

As mentioned previously, temperature moderators may be utilized with the subject process burner. These temperature moderators are usually used in admixture with the carbonaceous slurry stream and/or the oxygen-containing gas stream. Exemplary of suitable temperature moderators are water, steam, $CO_2$, $N_2$ and a recycled portion of the gas produced by the partial oxidation process described herein.

The fuel gas which is discharged exteriorly of the subject process burner includes such gases as methane, ethane, propane, butane, synthesis gas, hydrogen and natural gas.

BRIEF DESCRIPTION OF THE DRAWINGS

The high dispersion and atomization features of the process burners of this invention and other features which contribute to satisfaction in use and economy in manufacture for the process burner will be more fully understood from the following description of preferred embodiments of the invention when taken in connection with the accompanying drawings in which identical numerals refer to identical parts and in which:

Referring now to FIGS. 1 and 2, there can be seen a process burner of this invention, generally designated by the numeral 10. Process burner 10 is installed with the downstream end passing downwardly through a port made available in a partial oxidation synthesis gas reactor. Location of process burner 10, be it at the top or at the side of the reactor, is dependent upon reactor configuration. Process burner 10 may be installed either permanently or temporarily depending upon whether or not it is to be used with a permanently installed preheat burner or is to be utilized as a replacement for a preheat burner, all in the manner as previously described. Mounting of process burner 10 is accomplished by the use of annular flange 48.

Figure 1:
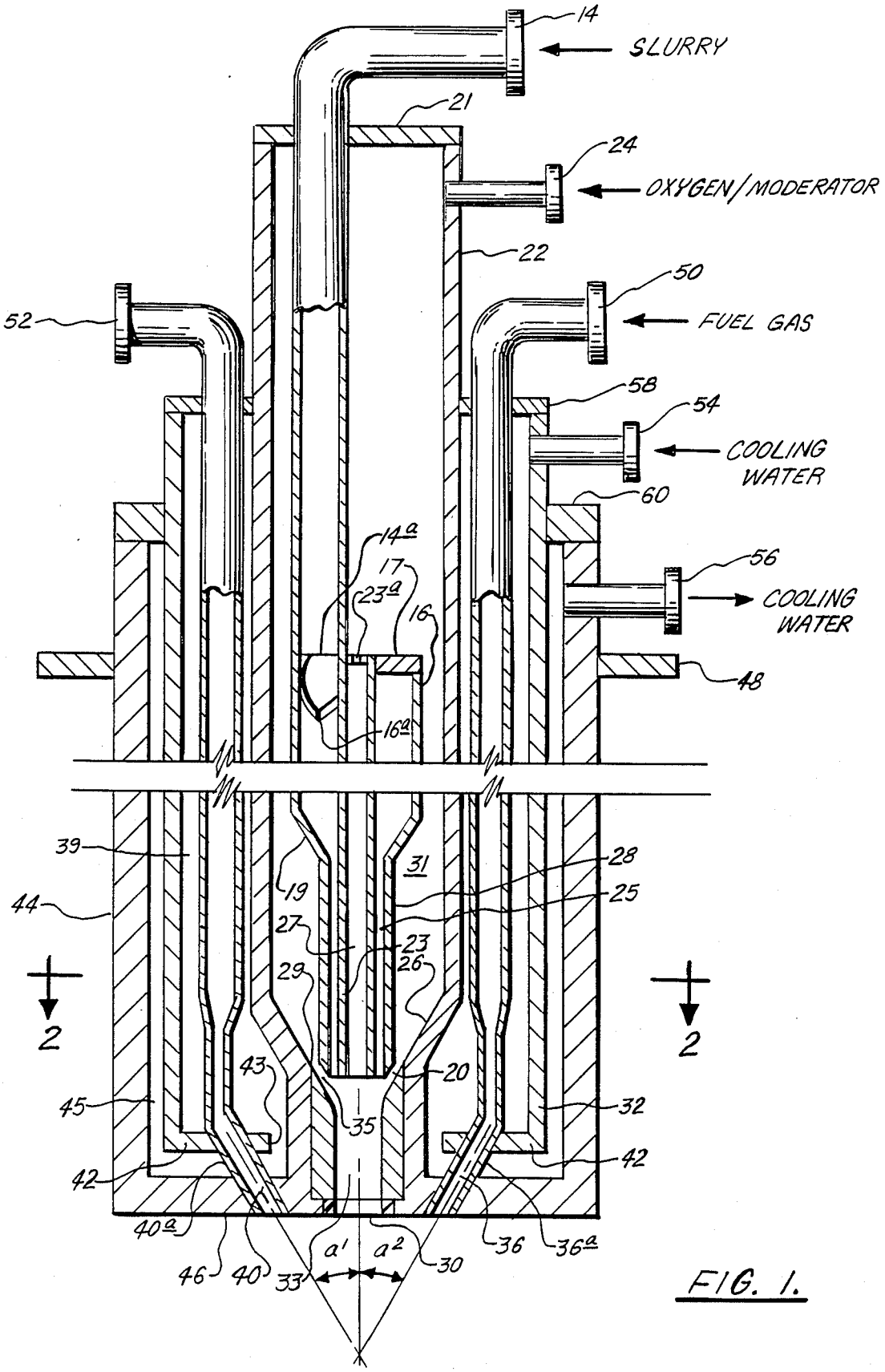
FIG. 1 is a vertical cross-sectional view showing a process burner of this invention.
Figure 2:
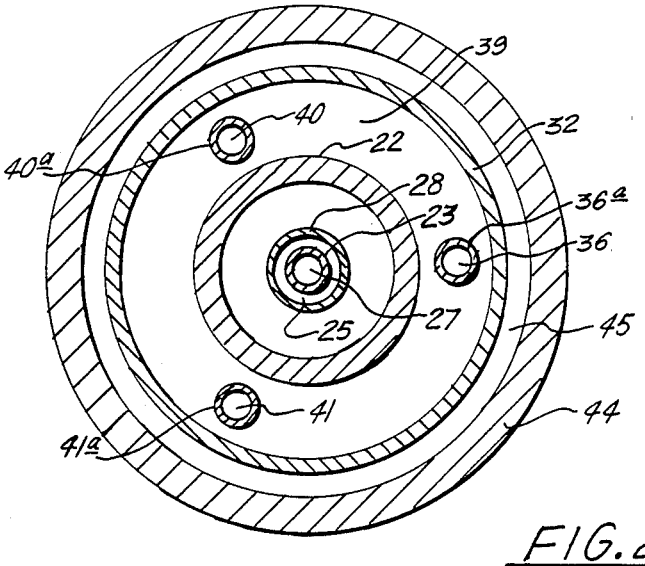
FIG. 2 is a sectional view taken through section lines 2—2 in FIG. 1.

Process burner 10 has a centrally disposed tube 22 which is closed off at its upper end by plate 21 and which has at its lower end a converging frusto-conical wall 26. At the apex of frusto-conical wall 26 is opening 35 which is in fluid communication with acceleration zone 33. Acceleration zone 33, at its lower end, terminates into opening 30. For the embodiment shown in the drawings, acceleration zone 33 is a hollow cylindrically shaped zone having sides which smoothly curve from the apex of the frusto-conical wall 26 to a right cylindrical section.

Passing through and in gas-tight relationship with an aperture in plate 21 is carbonaceous slurry feed line 14. Carbonaceous slurry feed line 14, at its lowermost end is connected to a port in an annular plate 17 which closes off the upper end of a distributor 16. Distributor 16 has a converging frusto-conical lower wall 19. At the apex of frusto-conical wall 19 is a downwardly depending tube 28 which defines an annular slurry conduit 25. The inside diameter of tube 28 is substantially less than the inside diameter, at its greatest extent, of distributor 16. It has been found that by utilizing distributor 16 the flow of carbonaceous slurry from the opening found at the bottom of conduit 25 will be substantially uniform throughout its annular extent. Determination of the inside diameter of the distributor 16 and the inside diameter of tube 28 is made so that the pressure drop that the carbonaceous slurry experiences as it passes through annular conduit 25, defined by the inside wall of tube 28 and the outside wall of tube 23, is much greater than the difference between the highest and lowest pressures present in the slurry measured across any annular horizontal cross-sectional plane inside of distributor 16. Distributor 16 also carries mixing plate **16*a* angularly disposed beneath the fluid flow inlet 14*a* of slurry feed line 14. Plate 16***a* can be at an angle which converts a substantial amount of axial flow of the slurry feed to generally radial flow in distributor 16. If this pressure and flow relationship is not maintained, it has been found that uneven annular flow will occur from annular conduit 25 resulting in the loss of dispersion efficiency when the carbonaceous slurry contacts the frusto-conical oxygen-containing gas streams as hereinafter described.

The difference in the inside and outside diameters of annular conduit 25 is at least partially dependent upon the fineness of the carbonaceous material found in the slurry. The diameter differences of annular conduit 25 should be sufficiently large to prevent plugging with the particular size of the carbonaceous material found in the slurry utilized. The difference in inside and outside diameters of annular conduit 25 will, in many applications, be within the range of from about 0.1 to about 1.0 inches.

Coaxial with both the longitudinal axis of distributor 16 and downwardly depending tube 28 is tube 23 which has, throughout its extent, a substantially uniform diameter. The tube 23 provides a conduit 27 for the passage of an oxygen-containing gas and is open at both its upstream and downstream ends with the downstream opening being substantially coplanar with the opening of the downstream end of tube 28.

The oxygen-containing gas is fed to process burner 10 through feed line 24. A portion of the oxygen-containing gas will pass into the open end of tube 23 and through conduit 27. The remainder of the oxygen-containing gas flows through annular conduit 31 defined by the inside wall of tube 22 and the outside wall of tube 28. It has been found that from about 70 to about 95 weight percent of the oxygen-containing gas should pass through conduit 31 in order to reduce the slurry feed from eroding the acceleration conduit 35. One means to accomplish this is by sizing the conduits properly. Another means for accomplishing this result is to place a restricting ring 23*a* in the fluid inlet to conduit 23. The gas passing through conduit 31 will be accelerated as it is forced through the frusto-conical conduit defined by frusto-conical surface 26 and frusto-conical surface 20. The distance between frusto-conical surfaces 20 and 26 can be such to provide the oxygen-containing gas velocity required to effectively disperse the carbonaceous slurry flowing out of carbonaceous slurry conduit 25. For example, it has been found that when the oxygen-containing gas passes through conduit 27 at a calculated velocity of about 200 ft/sec and the carbonaceous slurry passes through annular conduit 25 at a velocity of about 8 ft/sec and has an inside, outside diameter difference of about 0.3 inches, the oxygen-containing gas should pass through the frusto-conical conduit at a calculated velocity of about 200 ft/sec. Generally speaking, for the flows of just and hereinafter discussed, the distance between the two frusto-conical surfaces is within the range of from about 0.05 to about 0.95 inches. With these flows and relative velocities, it has also been found that the height and diameter of acceleration zone 33 should be about 7 inches and about 1.4 inches, respectively.

Frusto-conical surface 26 converges to the extended longitudinal axis of tube 28 along an angle within the range of from about 15° to about 75°. If the angle is too shallow, say 10°, then the oxygen-containing gas expends much of its energy impacting the surface. However, if the angle is too deep, then the shear achieved is minimized.

Concentrically located with respect to tube 22 is tubular water jacket 32. Water jacket 32 is closed off at its uppermost end by annular plate 58. At the lowermost end of water jacket 32 is annular plate 42 which extends inwardly but which provides an annular water passageway 43. Located within the annular space 39 found between the outside wall of tube 22 and the inside wall of water jacket 32 are three fuel gas conduits 36, 40 and 41. The fuel gas conduits 36, 40 and 41 are provided by tubes 36*a* and 40*a* and 41*a* respectively. Tubes 36*a*, 40*a* and 41*a* pass through apertures in flange 42 as seen in FIG. 1. Fuel gas is fed through tubes 40*a* and 36*a* by way of feed lines 52 and 50 respectively. The feed line for tube 41*a* is not shown but is the same type utilized for the other tubes.

As can also be seen in FIG. 1, fuel gas conduits 40 and 36 (and likewise for fuel gas conduit 41), are angled towards the extended longitudinal axis of tube 28. The conduits are also equiangularly and equidistantly radially spaced about this same axis. This angling and spacing is beneficial as it uniformly directs the fuel gas into the carbonaceous slurry/oxygen-containing gas dispersion subsequent to its flow through opening 30. The choice of angularity for the fuel gas conduits should be such that the fuel gas is introduced sufficiently far away from the burner face but not so far as to impede quick mixing or dispersion of the fuel gas into the carbonaceous slurry/oxygen-containing gas stream. Generally speaking, the angles a1 and a2 as seen in FIG. 1 should be within the range of from about 30° to about 70°.

Concentrically mounted and radially displaced outwardly from the outside wall of water jacket 32 is burner shell 44. The radial outward displacement of burner shell 44 provides for an annular water conduit 45. At the upper end of burner shell 44 is water discharge line 56. As is seen in FIG. 1, water which enters through water feed line 54 flows to and through water passageway 43 and thence through annular water conduit 45 and out water discharge line 56. This flow of water is utilized to keep process burner 10 at a desired and substantially constant temperature.

Burner shell 44 is closed off at its upper end in a water-tight manner by annular flange 60. Burner shell 44 is terminated at its lowermost end by burner face 46.

In operation, the process burner 10 is brought on line subsequent to the reaction zone completing its preheat phase which brings the zone to a temperature within the range of from about 1500° to about 2500° F. (815.6°-1370° C.). The relative proportions of the feed streams and the optional temperature moderator that are introduced into the reaction zone through process burner 10, are carefully regulated so that a substantial portion of the carbon in the carbonaceous slurry and the fuel gas is converted to the desirable CO and $H_2$ components of the product gas and so that the proper reaction zone temperature is maintained.

The dwell time in the reactor for the feed streams subsequent to their leaving process burner 10 will be about 1 to about 10 seconds.

The oxygen-containing gas will be fed to process burner 10 at a temperature dependent upon its $O_2$ content. For air, the temperature will be from about ambient to about 1200° F. (648.9° C.), while for pure $O_2$, the temperature will be in the range of from about ambient to about 800° F. (426.7° C.). The oxygen-containing gas will be fed under a pressure of from about 30 to about 3500 psig (206.8–24,131.7 kilopascals). The carbonaceous slurry will be fed at a temperature of from about ambient to about the saturation temperature of the liquid carrier and at a pressure of from about 30 to about 3500 psig. The fuel gas, which is utilized to maintain the reaction zone at the desired temperature range, is preferably methane and is fed at a temperature of from about ambient to about 1200° F. (648.9° C.) and under a pressure of from about 30 to about 3500 psig (206.8–24,131.7 kilopascals). Quantitatively, the carbonaceous slurry, fuel gas and oxygen-containing gas will be fed in amounts to provide a weight ratio of free oxygen to carbon which is within the range of from about 0.9 to about 2.27.

The carbonaceous slurry is fed via feed line 14 to the interior of distributor 16 at a preferred flow rate of from about 0.1 to about 20 ft/sec (about 0.0365 to about 5.08 m/sec). Due to the smaller diameter of carbonaceous slurry conduit 25, the velocity of the carbonaceous slurry will increase to be within the range of from about 1 to about 50 ft/sec. (about 0.365 to about 15.2 m/sec).

The oxygen-containing gas is fed through feed line 24 and is made into two streams, one stream passing through gas conduit 27 and the other passing to form a frusto-conical stream in conduit 29. The oxygen-containing gas streams can have different velocities, for example, the velocity through gas conduit 27 can be 200 ft/sec (61 m/sec) and the velocity through the frusto-conical conduit 29 can be 300 ft/sec (91.4 m/sec). As mentioned previously, the annular carbonaceous stream exits carbonaceous slurry conduit 25 and is intersected by a frusto-conical stream of oxygen-containing gas just beneath the lowermost extent of tube 28 and tube 23. The resultant shearing of the annular carbonaceous slurry stream by the frusto-conical oxygen-containing gas stream in combination with the centrally fed oxygen-containing gas stream from conduit 27 results in substantially uniform dispersion of the carbonaceous slurry within the oxygen-containing gas.

The resultant dispersion is then passed through acceleration zone 33 which is dimensioned and configured to accelerate the oxygen-containing gas to a sufficient velocity to further atomize the carbonaceous slurry to a volume median droplet size within the range of from about 100 to about 600 microns.

When burner nozzle 10 is initially placed into operation the rate of fuel gas feed will be predominant over the rate of carbonaceous slurry feed. As the carbonaceous slurry feed is increased, however, the rate of fuel gas feed is decreased. This contemporaneous slow conversion from fuel gas feed to carbonaceous slurry feed will continue until fuel gas feed is completely stopped. Should a reaction zone upset occur and the carbonaceous slurry feed have to be reduced, then the fuel gas feed will be brought back on line in an amount sufficient to keep the reaction zone within the desired temperature range.

Figure 4:
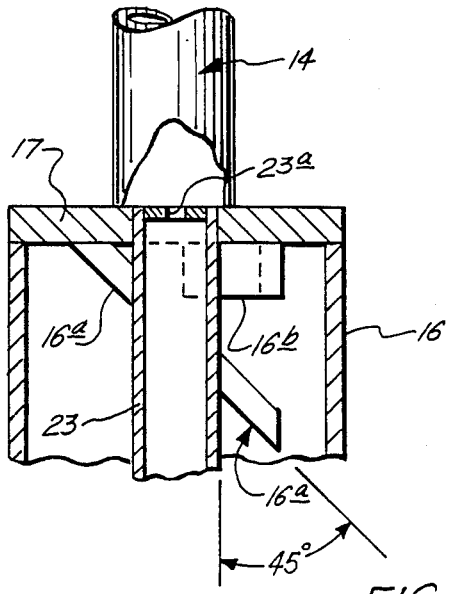
FIG. 4 is a sectional view of the distribution chamber of FIG. 3 taken through section lines 4—4.
Figure 3:
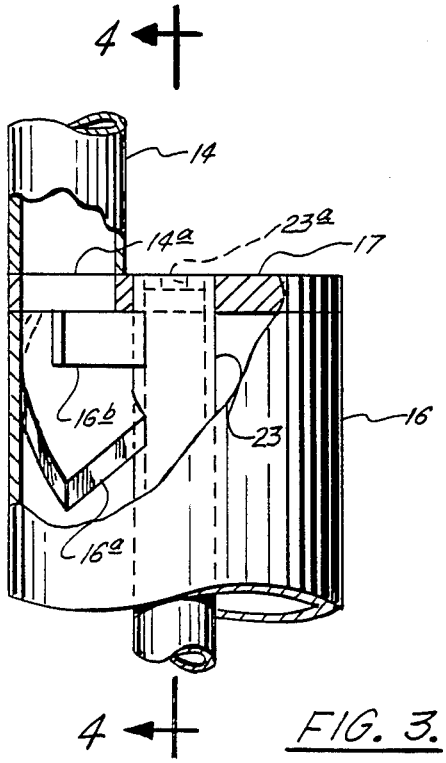
FIG. 3 is a partial sectional view of the distribution chamber of the annular passageway.
Figure 5:
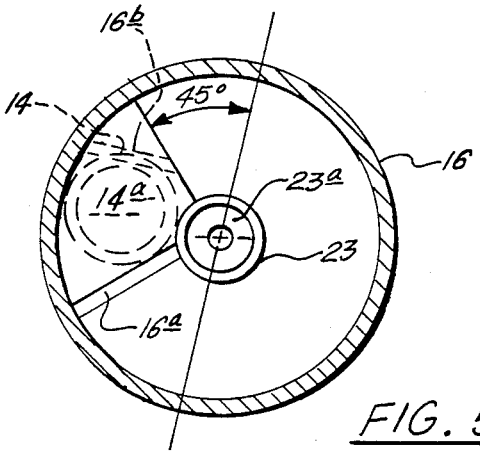
FIG. 5 is a bottom view of the distribution chamber as shown in FIG. 3.

Referring to FIGS. 3–5, a further description of the mixing plate **16*a* is given. As shown, mixing plate 16*a* extends downwardly from annular plate 17 at a 45 degree angle. Preferably, it extends for a rotational angle of about 90 degrees about the conduit 23, although this can vary from about 75 to about 115 degrees. In order to insure that the axial flow of the slurry will be achieved, a blocking plate 16*b* can be added to prevent the slurry from avoiding the mixing plate 16*a***.

I claim:

1. A process burner which comprises:

(a) concentric and radially spaced central and middle conduits, wherein (i) the central conduit defines a cylindrical passageway having an open discharge end and closed at its upstream end except for having a first fluid feed inlet upstream of its discharge end for a first fluid feed, and (ii) the middle conduit and central conduit define an annular passageway concentric with the central passageway, the annular passageway having an open discharge end, a closed upstream end except for a second fluid feed inlet for a second fluid feed, the annular passageway upstream end having a sufficiently larger cross-sectional area than said discharge end to form a distribution chamber whereby the pressure of the second fluid feed is equalized and said second fluid feed enters the relatively smaller downstream end of said annular passageway free from high fluid flow regions, said distribution chamber containing a mixing plate adjacent and below the second fluid feed inlet, disposed at such an angle to the entering second fluid feed that the generally axial flow of said second fluid feed is changed to substantially radial flow whereby high fluid feed regions are prevented and having the discharge end of the annular passageway lying substantially in the same plane as the discharge end of the central passageway;

(b) a frusto-conical conduit defining a frusto-conical passageway which is coaxial with and displaced radially outward from the annular passageway and is in fluid communication with the central conduit and sized such that from about 70 to about 95 weight percent of the first fluid feed flows through the frusto-conical passageway which converges towards a point downstream of the discharge ends of the central and annular passageways; and (c) an acceleration conduit defining a coaxial acceleration passageway which is coaxial and in fluid communication with and located downstream from the central, middle and frusto-conical passageways, and connected to the apex of the frusto-conical conduit, the acceleration passageway having a cross-section area for flow less than the combined cross-sectional areas for flow of the central, middle and frusto-conical conduits at their discharge ends, said acceleration conduit having a longitudinal cross-section which converges in a smooth curve to a cylindrical bore, so that excessive wear rates are prevented.

2. The process burner of claim 1 wherein said acceleration conduit is composed of a material selected from the group consisting of tungsten carbide, silicon carbide, or boron carbide.

3. The process burner of claim 2 wherein said acceleration conduit is composed of tungsten carbide.

4. The process burner of claim 2 wherein said acceleration conduit is composed of silicon carbide.

5. A process burner which comprises:

(a) concentric and radially spaced central and middle conduits, wherein (i) the central conduit defines a cylindrical passageway having an open discharge end and closed at its upstream end except for having a first fluid feed inlet upstream of its discharge end for a first fluid feed, and (ii) the middle conduit and central conduit define an annular passageway concentric with the central passageway, the annular passageway having an open discharge end, a closed upstream end except for a second fluid feed inlet for a second fluid feed inlet, the annular passageway upstream end having a sufficiently larger cross-sectional area than said discharge end to form a distribution chamber whereby the pressure of the second fluid feed is equalized and said second fluid feed enters the relatively smaller downstream end of said annular passageway free from high fluid flow regions, said distribution chamber containing a mixing plate adjacent and below the second fluid feed inlet, disposed at such an angle to the entering second fluid feed that the generally axial flow of said second fluid feed is changed to substantially radial flow whereby high fluid feed regions are prevented and having the discharge end of the annular passageway lying substantially in the same plane as the discharge end of the central passageway;

(b) a frusto-conical conduit defining a frusto-conical passageway which is coaxial with and displaced radially outward from the annular passageway and is in fluid communication with the central conduit and sized such that from about 70 to about 95 weight percent of the first fluid feed flows through the frusto-conical passageway which converges towards a point downstream of the discharge ends of the central and annular passageways; and (c) an acceleration conduit defining a coaxial acceleration passageway which is coaxial and in fluid communication with and located downstream from the central, middle and frusto-conical passageways, and connected to the apex of the frusto-conical conduit, the acceleration passageway having a cross-sectional area for flow less than the combined cross-sectional areas for flow of the central, middle and frusto-conical conduits at their discharge ends.

6. The process burner of claim 5 wherein said mixing plate lies at about a 45 degree angle from the longitudinal axis of the annular passageway.

7. The process burner of claim 6 wherein said mixing plate lies between said central conduit and said middle conduit in said annular passageway and extends downwardly for a rotational angle of about 90 degrees.

8. The process burner of claim 1 wherein the smooth curve of said acceleration conduit contacts said frusto-conical passageway discharge end tangentially.

* * * * *